US011359354B2

(12) United States Patent
Sherlock

(10) Patent No.: US 11,359,354 B2
(45) Date of Patent: Jun. 14, 2022

(54) BIRDS-EYE-VIEW AS CAILIBRATION FOR GRADE CONTROL

(71) Applicant: Deere & Company, Moline, IL (US)

(72) Inventor: Lance R. Sherlock, Potosi, WI (US)

(73) Assignee: DEERE & COMPANY, Moline, IL (US)

( * ) Notice: Subject to any disclaimer, the term of this patent is extended or adjusted under 35 U.S.C. 154(b) by 230 days.

(21) Appl. No.: 16/250,073

(22) Filed: Jan. 17, 2019

(65) Prior Publication Data

US 2020/0232192 A1 Jul. 23, 2020

(51) Int. Cl.

| | |
|---|---|
| ***E02F 9/26*** | (2006.01) |
| ***E02F 3/84*** | (2006.01) |
| ***E02F 3/76*** | (2006.01) |

(52) U.S. Cl.

CPC ..... *E02F 9/265* (2013.01); *E02F 3/7613* (2013.01); *E02F 3/7618* (2013.01); *E02F 3/844* (2013.01)

(58) Field of Classification Search

CPC ..... E02F 9/265; E02F 3/7613; E02F 3/844; E02F 3/7618; G05D 1/0246

See application file for complete search history.

(56) References Cited

U.S. PATENT DOCUMENTS

| | | | | |
|---|---|---|---|---|
| 6,735,889 | B1 * | 5/2004 | Berger | E02F 9/2004 37/348 |
| 9,957,692 | B2 * | 5/2018 | Morin | E02F 3/847 |
| 10,597,853 | B2 * | 3/2020 | Okui | G01B 11/26 |
| 10,634,492 | B2 * | 4/2020 | Beery | E02F 3/7636 |
| 2009/0031721 | A1 * | 2/2009 | Palo | E02F 9/2235 60/449 |
| 2010/0121540 | A1 * | 5/2010 | Kumagai | G01C 11/06 701/50 |
| 2018/0319392 | A1 * | 11/2018 | Posselius | E02F 9/24 |

* cited by examiner

*Primary Examiner* — Fadey S. Jabr
*Assistant Examiner* — Omar K Morsy
(74) *Attorney, Agent, or Firm* — Taft Stettinius & Hollister LLP; Stephen F. Rost

(57) ABSTRACT

A system includes calibrating a grade control system of a work vehicle having a controller operatively connected to a camera. A plurality of cylinders operative to move a blade on the vehicle. The blade includes one or more blade markers. One of the cylinders moves to a predetermined configuration that is between 0% and 100% of maximum stroke length, and the camera takes a corresponding image of the one or more blade markers. The controller measures a corresponding location of the one or more blade markers using the corresponding image and calibrates the grade control system based on the corresponding location of the one or more blade markers. The stored corresponding location can be an initial calibration location or a corresponding calibration location that was previously determined during operating conditions of the work vehicle. The grade control system is calibrated in real-time while the work vehicle is operating or stationary.

20 Claims, 4 Drawing Sheets

BIRDS-EYE-VIEW AS CAILIBRATION FOR GRADE CONTROL

FIELD OF THE DISCLOSURE

The present disclosure relates to a work vehicle that recalibrates a grade control system by use of a camera system and targets on a rear face of a blade.

BACKGROUND OF THE DISCLOSURE

A work vehicle, such as a crawler, can be used in construction and maintenance for creating a flat surface at various angles, slopes, and elevations. When paving a road for instance, a crawler can be used to prepare a base foundation to create a wide flat surface to support a layer of asphalt. The crawler includes a blade that is adjustable to a selected angle with respect to gravity or blade slope and an elevation of the blade is also adjustable.

To properly grade a surface, the work vehicle includes a plurality of sensors. One sensor system measures the orientation of the vehicle with respect to gravity.

Another sensor system measures the location of the blade with respect to the vehicle or with respect to gravity. Machine control systems, which include two dimensional (2D) and three dimensional (3D) machine control systems, can be located at or near the surface being graded to provide grade information to the work vehicle. A vehicle grade control system receives signals from the machine control system to enable the work vehicle to grade the surface. The grade control system is operatively coupled to one or more sensors attached to the work vehicle, so that the surface being graded can be graded to the desired slope, angle, and elevation. The desired grade of the surface is planned ahead of or during a grading operation.

Machine control systems can provide slope and elevation signals to the vehicle grade control system to enable the work vehicle or an operator to adjust the slope and elevation of the blade. Alternatively, the vehicle grade control system can be configured to automatically control the slope and elevation of the blade to grade the surface based on desired slopes and elevations. In these automatic systems, adjustments to the position of the blade with respect to the vehicle are made constantly in order to achieve the slope and/or elevation targets.

The vehicle grade control system needs to be calibrated to ensure that the desired slopes and elevations will be achieved. For the operator to calibrate the vehicle grade control system of a crawler, the operator will typically use a tape measure, a plumb bob, and a T-square or carpenter's square to measure a relative position of the blade tip to the GPS antenna or receiver. As one can appreciate, there are many measurements that the operator must perform to determine the relative position of the blade tip to the GPS antenna and the work vehicle, such as a crawler, is a rather large machine that is difficult for the user to accurately measure with the above mentioned tools. Moreover, often during a grading operation the operator is expected to achieve a grading tolerance to within 0.5 inches of a design elevation, therefore having an accurately calibrated vehicle grade control system is very important. An operator typically spends about 3 hours to measure and calibrate the machine to achieve 0.5 inch accuracy during which time the machine is not operational.

Another work vehicle that includes a blade for grading is a motor grader. The blade is attached to the motor grader between a front axle and rear axle. The blade can rotate, tilt, and raise or lower which results in a very complex process to calibrate the blade tip. Moreover, often during a grading operation the operator is expected to achieve a grading tolerance to within 3 millimeters of a design elevation, therefore having an accurately calibrated vehicle grade control system and blade tip is very important. An operator typically spends about 5 hours to measure and calibrate the motor grader to achieve a 3 millimeter accuracy during which time the machine is not operational.

For the crawler, motor grader, or other work vehicles that include a blade for grade control, over time and usage of the vehicle the tracks wear down which if not accounted for will affect the elevation of the blade tip. As the elevation changes, then the blade tip needs to be recalibrated to maintain the desired accuracy. The operator must repeat this process regularly to re-calibrate the blade tip to maintain a desired accuracy. During each of these re-calibration periods, the work vehicle is not operational which creates downtime for the operator and lost profits.

What is needed, therefore, is a system, apparatus, and method to more easily, frequently, and accurately determine the precise location of the blade tip over time.

SUMMARY

According to one embodiment of the present disclosure, a method for calibrating a grade control system of a work vehicle, comprising providing a work vehicle having a controller operatively connected to a camera, the work vehicle having a lift cylinder, a tilt cylinder, and an angle cylinder, operatively connected to a blade, the blade having a rear face with a first blade marker thereon; moving one of the lift cylinder, the tilt cylinder, or the angle cylinder to a corresponding predetermined configuration; taking a first image of the first blade marker with the camera; measuring, with the controller, a first location of the first blade marker using the first image; and calibrating, with the controller, the grade control system based on the first location of the first blade marker by replacing a stored first location of the first blade marker with the first location of the first blade marker.

In one example of this embodiment, further comprising wherein the rear face of the blade includes a second blade marker thereon; taking a second image of the second blade marker with the camera; measuring, with the controller, a second location of the second blade marker using the second image; and wherein the calibrating the grade control system includes based on the second location of the second blade marker replacing a stored second location of the second blade marker with the second location of the second blade marker.

In another example, the stored first location of the first blade marker includes an initial first calibration location and the stored second location of the second blade marker includes an initial second calibration location.

In another example, the stored first location of the first blade marker includes a first calibration location and the stored second location of the second blade marker includes a second calibration location.

In one example, the predetermined configuration is 100% of a maximum stroke length of one of the lift cylinder, the tilt cylinder, or the angle cylinder.

In another example, the predetermined configuration is between 0% and 100% of a maximum stroke length of one of the lift cylinder, the tilt cylinder, or the angle cylinder.

In one example, the camera is mounted on the work vehicle.

In another example, further comprising: moving the work vehicle during the moving of one of the lift cylinder, the tilt cylinder, or the angle cylinder.

According to another embodiment of the present disclosure, a work vehicle, comprising: a blade operatively attached to the work vehicle, the blade having a rear face with a first blade marker and a second blade marker thereon; a lift cylinder, a tilt cylinder, and an angle cylinder operatively connected to the blade, the lift cylinder, the tilt cylinder, and the angle cylinder configured to move to a corresponding predetermined configuration; a sensor system coupled to the lift cylinder, the tilt cylinder, and the angle cylinder, the sensor system configured to identify the corresponding predetermined configuration of the lift cylinder, the tilt cylinder, and the angle cylinder; a camera mounted on the work vehicle, the camera configured to take a first image of the first blade marker and to take a second image of the second blade marker when any of the corresponding predetermined configurations of the lift cylinder, the tilt cylinder, and the angle cylinder, are satisfied; a grade control system mounted on the work vehicle; and a controller operatively connected to the sensor system, the camera, and the grade control system, wherein the controller further determines a first location of the first blade marker using the first image and a second location of the second blade marker using the second image, and the controller calibrates the grade control system based on the first location and the second location by replacing a stored first location of the first blade marker with the first location and replacing a stored second location of the second blade marker with the second location.

In one example of this embodiment, the predetermined configuration is 100% of a maximum stroke length of one of the lift cylinder, the tilt cylinder, or the angle cylinder.

In another example of this embodiment, the predetermined configuration is between 0% and 100% of a maximum stroke length of one of the lift cylinder, the tilt cylinder, or the angle cylinder.

In one example, the first blade marker and the second blade marker are positioned near a top edge of the blade.

In another example the first blade marker and the second blade marker are positioned equidistant from a centerline of the blade.

In one example, each of the first blade marker and the second blade marker include a sensor that interacts with the camera.

In another example, the first blade marker and the second blade marker are machined into the rear face.

According to another embodiment of the present disclosure, a method for calibrating a grade control system of a work vehicle, the method comprising: providing a work vehicle having a controller operatively connected to a camera, the work vehicle having a plurality of cylinders operatively connected to a blade, the blade having a rear face with one or more blade markers thereon; moving one of the plurality of cylinders to a corresponding predetermined configuration; taking a corresponding image of the one or more blade markers with the camera; measuring, with the controller, a corresponding location of the one or more blade markers using the corresponding image; calibrating, with the controller, the grade control system based on the corresponding location of the one or more blade markers by replacing a stored corresponding location of the one or more blade markers with the corresponding location of the one or more blade markers.

In one example of this embodiment, the stored corresponding location includes an initial corresponding calibration location.

In another example of this embodiment, the stored corresponding location includes a corresponding calibration location.

In one example, the predetermined configuration is between 0% and 100% of a maximum stroke length of one of the plurality of cylinders.

In another example, further comprising moving the work vehicle during the moving of one of the plurality of cylinders.

Further objects, forms, embodiments, benefits, advantages, features, and aspects of the present application shall become apparent from the description and drawings contained herein.

BRIEF DESCRIPTION OF THE DRAWINGS

In order that the advantages of the subject matter may be more readily understood, a more particular description of the subject matter briefly described above will be rendered by reference to certain embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Generally the present disclosure is directed to a bird's eye view camera system on a crawler that interacts with targets, markers, or sensors on a rear face of a blade. In one form, as one or more of lift cylinders, tilt cylinder, and/or angle cylinders associated with the blade reaches a full blade vertical up or down position, a full blade tilt position, and/or a full blade angle position, then the camera system takes a measurement to the targets, markers, or sensors on the rear face of the blade. In another form, one or more of the lift cylinders, tilt cylinder, and/or angle cylinders reaches a predetermined configuration that is less than a maximum or minimum stroke of the cylinders, then the camera system takes a measurement to the targets, markers, or sensors on the rear face of the blade. The distance from the bird's eye view camera to the targets, markers, or sensors is a known value however over time the location of the targets may change as the work vehicle wears. By measuring the location of the targets at the maximum, minimum, and/or predetermined configurations of one or more of lift cylinders, tilt cylinder, and/or angle cylinders, the vehicle grade system can be calibrated in real time. The work vehicle continues to be used or operated while the camera system takes measurements therefore there is no down time or very limited down time when the work vehicle is not operational. Moreover, the grade control system is constantly updated or revised to account for wear of the work vehicle while allowing the operator to achieve accurate grade or slope control with the blade.

Figure 1:
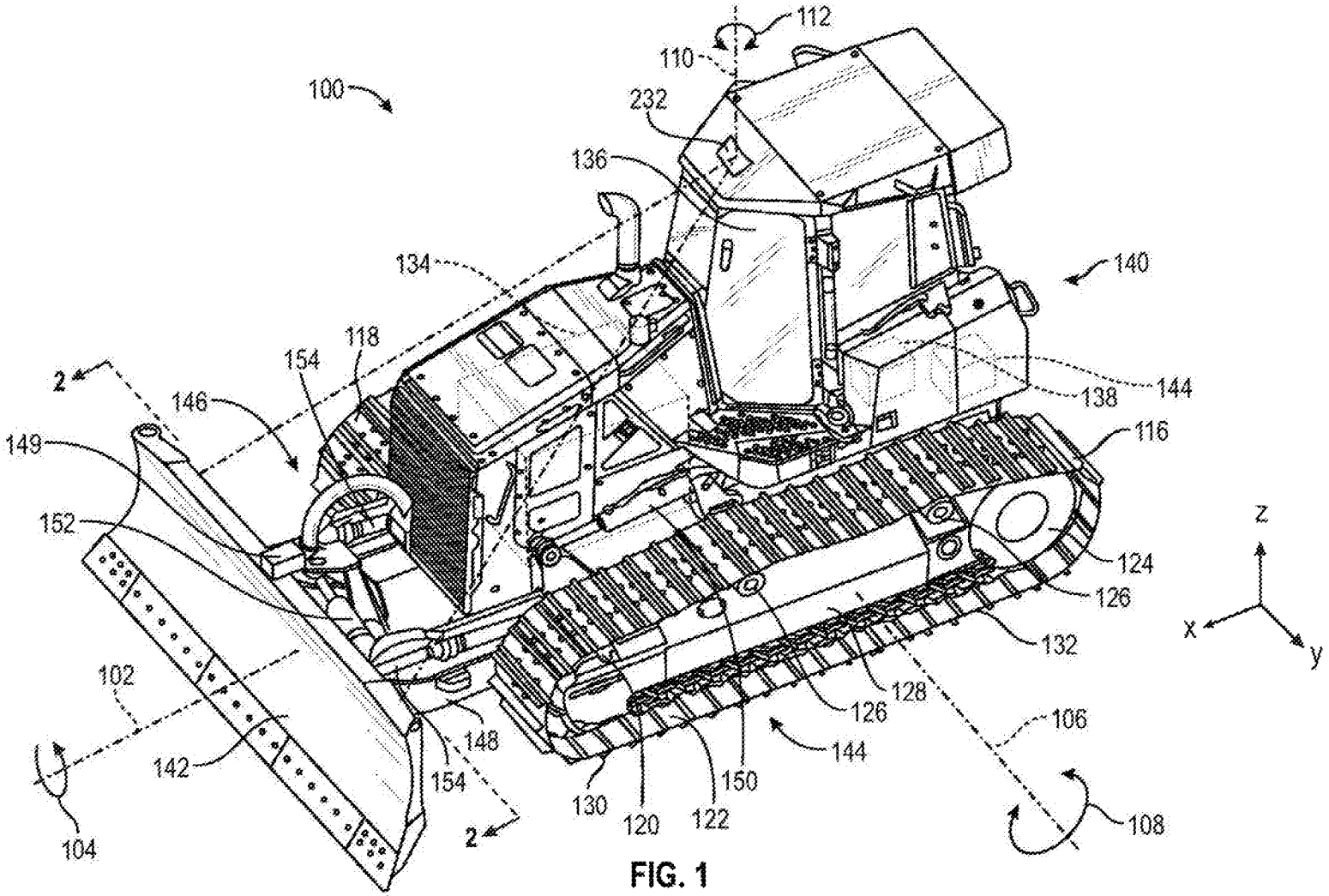
FIG. 1 is a top perspective view of a work vehicle, and more specifically, of a bulldozer such as a crawler dozer including a blade.

FIG. 1 is a perspective view of work vehicle 100. Work vehicle 100 is illustrated as a crawler dozer, which may also be referred to as a crawler, but may be any work vehicle with a ground-engaging blade or work implement such as a compact track loader, motor grader, scraper, skid steer, tractor, backhoe, and excavator, to name a few examples. Work vehicle 100 may be operated to engage the ground and cut and move material to achieve simple or complex features on the ground. As used herein, directions with regard to work vehicle 100 may be referred to from the perspective of an operator seated within operator station 136: the left of work vehicle 100 is to the left of such an operator, the right of work vehicle 100 is to the right of such an operator, the front or fore of work vehicle 100 is the direction such an operator faces, the rear or aft of work vehicle 100 is behind such an operator, the top of work vehicle 100 is above such an operator, and the bottom of work vehicle 100 is below such an operator. While operating, work vehicle 100 may experience movement in three directions and rotation in three directions. Direction for work vehicle 100 may also be referred to with regard to longitude 102 or the longitudinal direction, latitude 106 or the lateral direction, and vertical 110 or the vertical direction. Rotation for work vehicle 100 may be referred to as roll 104 or the roll direction, pitch 108 or the pitch direction, and yaw 112 or the yaw direction or heading.

Work vehicle 100 is supported on the ground by undercarriage 114. Undercarriage 114 includes left track 116 and right track 118, which engage the ground and provide tractive force for work vehicle 100. Left track 116 and right track 118 may be comprised of shoes with grousers that sink into the ground to increase traction, and interconnecting components that allow the tracks to rotate about front idlers 120, track rollers 122, rear sprockets 124 and top idlers 126. Such interconnecting components may include links, pins, bushings, and guides, to name a few components. Front idlers 120, track rollers 122, and rear sprockets 124, on both the left and right sides of work vehicle 100, provide support for work vehicle 100 on the ground. Front idlers 120, track rollers 122, rear sprockets 124, and top idlers 126 are all pivotally connected to the remainder of work vehicle 100 and rotationally coupled to their respective tracks so as to rotate with those tracks. Track frame 128 provides structural support or strength to these components and the remainder of undercarriage 114.

Front idlers 120 are positioned at the longitudinal front of left track 116 and right track 118 and provide a rotating surface for the tracks to rotate about and a support point to transfer force between work vehicle 100 and the ground. Left track 116 and right track 118 rotate about front idlers 120 as they transition between their vertically lower and vertically upper portions parallel to the ground, so approximately half of the outer diameter of each of front idlers 120 is engaged with left track 116 or right track 118. This engagement may be through a sprocket and pin arrangement, where pins included in left track 116 and right track 118 are engaged by recesses in front idler 120 so as to transfer force. This engagement also results in the vertical height of left track 116 and right track 118 being only slightly larger than the outer diameter of each of front idlers 120 at the longitudinal front of left track 116 and right track 118. Front-most engaging point 130 of left track 116 and right track 118 can be approximated as the point on each track vertically below the center of front idlers 120, which is the front-most point of left track 116 and right track 118 which engages the ground. When work vehicle 100 encounters a ground feature when traveling in a forward direction, left track 116 and right track 118 may first encounter it at front-most engaging point 130.

Track rollers 122 are longitudinally positioned between front idler 120 and rear sprocket 124 along the bottom left and bottom right sides of work vehicle 100. Each of track rollers 122 may be rotationally coupled to left track 116 or right track 118 through engagement between an upper surface of the tracks and a lower surface of track rollers 122. This configuration may allow track rollers 122 to provide support to work vehicle 100, and in particular may allow for the transfer of forces in the vertical direction between work vehicle 100 and the ground. This configuration also resists the upward deflection of left track 116 and right track 118 as they traverse an upward ground feature whose longitudinal length is less than the distance between front idler 120 and rear sprocket 124.

Rear sprockets 124 may be positioned at the longitudinal rear of left track 116 and right track 118 and, similar to front idlers 120, provide a rotating surface for the tracks to rotate about and a support point to transfer force between work vehicle 100 and the ground. Left track 116 and right track 118 rotate about rear sprockets 124 as they transition between their vertically lower and vertically upper portions parallel to the ground, so approximately half of the outer diameter of each of rear sprockets 124 is engaged with left track 116 or right track 118. This engagement may be through a sprocket and pin arrangement, where pins included in left track 116 and right track 118 are engaged by recesses in rear sprockets 124 so as to transfer force. This engagement also results in the vertical height of left track 116 and right track 118 being only slightly larger than the outer diameter of each of rear sprockets 124 at the longitudinal back or rear of left track 116 and right track 118. Rearmost engaging point 132 of left track 116 and right track 118 can be approximated as the point on each track vertically below the center of rear sprockets 124, which is the rearmost point of left track 116 and right track 118 which engages the ground. When work vehicle 100 encounters a ground feature when traveling in a reverse or backward direction, left track 116 and right track 118 may first encounter it at rearmost engaging point 132.

In this embodiment, each of rear sprockets 124 may be powered by a rotationally coupled hydraulic motor so as to drive left track 116 and right track 118 and thereby control propulsion and traction for work vehicle 100. Each of the left and right hydraulic motors may receive pressurized hydraulic fluid from a hydrostatic pump whose direction of flow and displacement controls the direction of rotation and speed of rotation for the left and right hydraulic motors. Each hydrostatic pump may be driven by engine 134 of work vehicle 100, and may be controlled by an operator in operator station 136 issuing commands which may be received by controller 138 and communicated to the left and right hydrostatic pumps by controller 138. In alternative embodiments, each of rear sprockets 124 may be driven by a rotationally coupled electric motor or a mechanical system transmitting power from engine 134.

Top idlers 126 are longitudinally positioned between front idlers 120 and rear sprockets 124 along the left and right sides of work vehicle 100 above track rollers 122. Similar to track rollers 122, each of top idlers 126 may be rotationally coupled to left track 116 or right track 118 through engagement between a lower surface of the tracks and an upper surface of top idlers 126. This configuration may allow top idlers 126 to support left track 116 and right track 118 for the longitudinal span between front idler 120 and rear sprocket 124, and prevent downward deflection of the upper portion of left track 116 and right track 118 parallel to the ground between front idler 120 and rear sprocket 124.

Undercarriage 114 is affixed to, and provides support and tractive effort for, chassis 140 of work vehicle 100. Chassis 140 is the frame which provides structural support and rigidity to work vehicle 100, allowing for the transfer of force between blade 142 and left track 116 and right track 118. In this embodiment, chassis 140 is a weldment comprised of multiple formed and joined steel members, but in alternative embodiments it may be comprised of any number of different materials or configurations. Sensor 144 is affixed to chassis 140 of work vehicle 100 and configured to provide a signal indicative of the movement and orientation of chassis 140. In alternative embodiments, sensor 144 may not be affixed directly to chassis 140, but may instead be connected to chassis 140 through intermediate components or structures, such as rubberized mounts. In these alternative embodiments, sensor 144 is not directly affixed to chassis 140 but is still connected to chassis 140 at a fixed relative position so as to experience the same motion as chassis 140.

Sensor 144 is configured to provide a signal indicative of the inclination of chassis 140 relative to the direction of gravity, an angular measurement in the direction of pitch 108. This signal may be referred to as a chassis inclination signal. Controller 138 may actuate blade 142 based on this chassis inclination signal. As used herein, "based on" means "based at least in part on" and does not mean "based solely on," such that it neither excludes nor requires additional factors. Sensor 144 may also be configured to provide a signal or signals indicative of other positions or velocities of chassis 140, including, its angular position, velocity, or acceleration in a direction such as the direction of roll 104, pitch 108, yaw 112, or its linear acceleration in a direction such as the direction of longitude 102, latitude 106, and vertical 110. Sensor 144 may be configured to directly measure inclination, measure angular velocity and integrate to arrive at inclination, or measure inclination and derive to arrive at angular velocity. The placement of sensor 144 on chassis 140 instead of on blade 142 or linkage 146 may allow sensor 144 to be better protected from damage, more firmly affixed to work vehicle 100, more easily packaged, or more easily integrated into another component of work vehicle 100 such as controller 138. This placement may allow for sensor 144 to be more cost effective, durable, reliable, or accurate than if sensor 144 were placed on blade 142 or linkage 146, even though placing sensor 144 directly on blade 142 or linkage 146 (such as sensor 149) may allow for a more direct reading of a position, velocity, or acceleration of those components.

Figure 2:
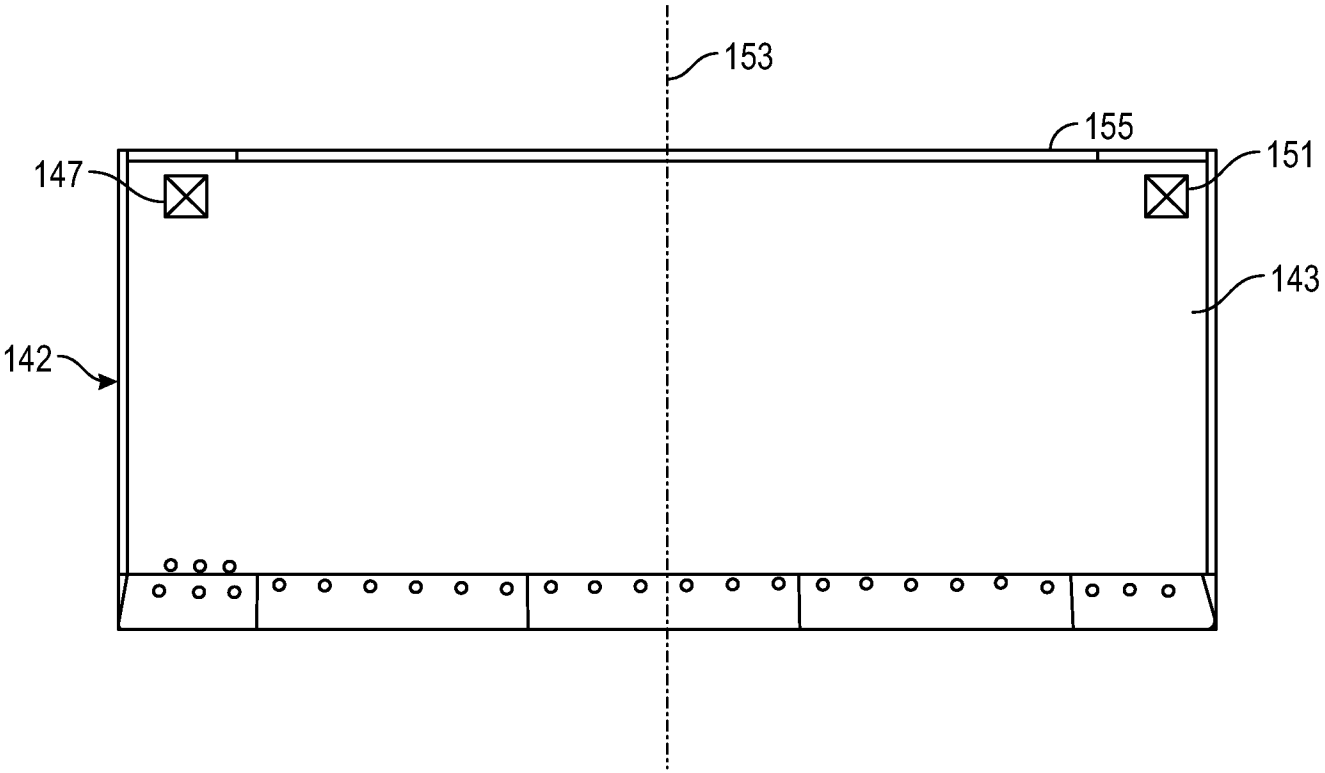
FIG. 2 is a rear view of the blade from the vehicle of FIG. 1.

Blade 142 is a work implement which may engage the ground or material to move or shape it. Blade 142 may be used to move material from one location to another and to create features on the ground, including flat areas, grades, hills, roads, or more complexly shaped features. In this embodiment, blade 142 of work vehicle 100 may be referred to as a six-way blade, six-way adjustable blade, or power-angle-tilt (PAT) blade. Blade 142 may be hydraulically actuated to move vertically up or vertically down (which may also be referred to as blade lift, or raise and lower), roll left or roll right (which may be referred to as blade tilt, or tilt left and tilt right), and yaw left or yaw right (which may be referred to as blade angle, or angle left and angle right). Alternative embodiments may utilize a blade with fewer hydraulically controlled degrees of freedom, such as a 4-way blade that may not be angled, or actuated in the direction of yaw 112. Blade 142 is movably connected to chassis 140 of work vehicle 100 through linkage 146, which supports and actuates blade 142 and is configured to allow blade 142 to be raised or lowered relative to chassis 140 (i.e., moved in the direction of vertical 110). In FIG. 2, a rear face 143 of the blade 142 includes a first marker or target 147 positioned near an upper left corner of the rear face 143. The rear face 143 of the blade 142 includes a second marker or target 151 positioned near an upper right corner of the rear face 143. As one example, the first marker 147 and the second marker 151 are each positioned an equidistance from a centerline 153 of the blade 142. Alternatively, the rear face 143 may only include one marker positioned on or near the centerline 153. In another configuration, the rear face 143 includes a plurality of markers positioned along or near a top edge 155 of the blade 142. In one form, the first and second markers 147 and 151 are machined or stamped into an outer surface of the rear face 143 of the blade 142. In other forms, the first and second markers 147 and 151 are attached to the rear face 143 of the blade. The first and second markers 147 and 151 can also include sensors that interact with a camera system 232. In any form, the first and second markers 147 and 151 are positioned or located on the rear face 143 of the blade 142 such that a camera system 232 positioned on the work vehicle 100 can take a first image of the first marker 147 and a second image of the second marker 151 as described in more detail below. The working vehicle 100 can be in (i) a working or moving orientation or (ii) a resting or non-moving orientation when the camera system 232 takes images of the first and second markers 147 and 151.

Linkage 146 may include multiple structural members to carry forces between blade 142 and the remainder of work vehicle 100 and may provide attachment points for hydraulic cylinders which may actuate blade 142 in the lift, tilt, and angle directions. Linkage 146 includes c-frame 148, a structural member with a C-shape positioned rearward of blade 142, with the C-shape open toward the rear of work vehicle 100. Each rearward end of c-frame 148 is pivotally connected to chassis 140 of work vehicle 100, such as through a pin-bushing joint, allowing the front of c-frame 148 to be raised or lowered relative to work vehicle 100 about the pivotal connections at the rear of c-frame 148. The front portion of c-frame 148, which is approximately positioned at the lateral center of work vehicle 100, connects to blade 142 through a ball-socket joint. This allows blade 142 three degrees of freedom in its orientation relative to c-frame 148 (lift-tilt-angle) while still transferring rearward forces on blade 142 to the remainder of work vehicle 100.

Sensor 149 is affixed to blade 142 above the ball-socket joint connecting blade 142 to c-frame 148. Sensor 149, like sensor 144, may be configured to measure angular position (inclination or orientation), velocity, or acceleration, or linear acceleration. Sensor 149 may provide a blade inclination signal, which indicates the angle of blade 142 relative to gravity. In alternative embodiments, a sensor may be configured to instead measure an angle of linkage 146, such as an angle between linkage 146 and chassis 140, in order to determine a position of blade 142. In other alternative embodiments, sensor 149 may be configured to measure a position of blade 142 by measuring a different angle, such as one between linkage 146 and blade 142, or the linear displacement of a cylinder attached to linkage 146 or blade 142. In alternative embodiments, sensor 149 may not be affixed directly to blade 142, but may instead be connected to blade 142 through intermediate components or structures, such as rubberized mounts. In these alternative embodiments, sensor 149 is not directly affixed to blade 142 but is still connected to blade 142 at a fixed relative position so as to experience the same motion as blade 142.

As described in more detail below, the sensor 149 may be configured to identify the corresponding predetermined configuration of the lift cylinders 150, the tilt cylinder 152, and the angle cylinders 154 when any of these cylinders move to a predetermined configuration which is then communicated from the sensor 149 to the ECU 250 which in turn communicates to the camera system 232 to take images of the first and second markers 147 and 151 as described below. The predetermined configuration of the lift cylinders 150, tilt cylinder 152, and the angle cylinders 154 can be any percentage of operable stroke for these cylinders. For example, in one form the predetermined configuration is 100% of maximum stroke of one of the cylinders 150, 152, and 154. When one of the cylinders 150, 152, and 154 reaches 100% of maximum stroke, the remaining two cylinders can be at any percentage of maximum stroke from 0% to 100% when the images of the first and second markers 147 and 151 are taken and the locations of the first and second markers 147 and 151 are measured. In another form the predetermined configuration is 25% of maximum stroke of one of the cylinders 150, 152, and 154. When one of the cylinders 150, 152, and 154 reaches 25% of maximum stroke, the remaining two cylinders can be positioned at any percentage of maximum stroke from 0% to 100% when the images of the first and second markers 147 and 151 are taken. In other forms, the predetermined configuration can be 30, 50, 75, or 90% of maximum stroke of one of the cylinders 150, 152, and 154 to name only a few examples. Moreover, the predetermined configuration can be adjusted over time as the work vehicle 100 wears. For a new work vehicle 100 that has not been used in field operating conditions, a vehicle grade control system 270 provides accurate grading information. However as the work vehicle 100 wears over time through field usage, the vehicle grade control system 270 does not provide accurate grading information unless the grade control system 270 is recalibrated. As any one of the cylinders 150, 152, and 154 reach the predetermined configuration the camera system 232 takes images of the first and second markers 147 and 151 and communicates this information to the ECU 250. The ECU 250 determines the locations of the first and second markers 147 and 151 and then communicates the information to the vehicle grade control system 270 which is then calibrated.

Blade 142 may be raised or lowered relative to work vehicle 100 by the actuation of lift cylinders 150, which may raise and lower c-frame 148 and thus raise and lower blade 142, which may also be referred to as blade lift. Although only one of the lift cylinders 150 is illustrated, the present disclosure includes two of lift cylinders 150. For each of lift cylinders 150, the rod end is pivotally connected to an upward projecting clevis of c-frame 148 and the head end is pivotally connected to the remainder of work vehicle 100 just below and forward of operator station 136. The configuration of linkage 146 and the positioning of the pivotal connections for the head end and rod end of lift cylinders 150 results in the extension of lift cylinders 150 lowering blade 142 and the retraction of lift cylinders 150 raising blade 142. In alternative embodiments, blade 142 may be raised or lowered by a different mechanism, or lift cylinders 150 may be configured differently, such as a configuration in which the extension of lift cylinders 150 raises blade 142 and the retraction of lift cylinders 150 lowers blade 142.

Blade 142 may be tilted relative to work vehicle 100 by the actuation of tilt cylinder 152, which may also be referred to as moving blade 142 in the direction of roll 104. For tilt cylinder 152, the rod end is pivotally connected to a clevis positioned on the back and left sides of blade 142 above the ball-socket joint between blade 142 and c-frame 148 and the head end is pivotally connected to an upward projecting portion of linkage 146. The positioning of the pivotal connections for the head end and the rod end of tilt cylinder 152 result in the extension of tilt cylinder 152 tilting blade 142 to the left or counterclockwise when viewed from operator station 136 and the retraction of tilt cylinder 152 tilting blade 142 to the right or clockwise when viewed from operator station 136. In alternative embodiments, blade 142 may be tilted by a different mechanism (e.g., an electrical or hydraulic motor) or tilt cylinder 152 may be configured differently, such as a configuration in which it is mounted vertically and positioned on the left or right side of blade 142, or a configuration with two tilt cylinders.

Blade 142 may be angled relative to work vehicle 100 by the actuation of angle cylinders 154, which may also be referred to as moving blade 142 in the direction of yaw 112. For each of angle cylinders 154, the rod end is pivotally connected to a clevis of blade 142 while the head end is pivotally connected to a clevis of c-frame 148. One of angle cylinders 154 is positioned on the left side of work vehicle 100, left of the ball-socket joint between blade 142 and c-frame 148, and the other of angle cylinders 154 is positioned on the right side of work vehicle 100, right of the ball-socket joint between blade 142 and c-frame 148. This positioning results in the extension of the left of angle cylinders 154 and the retraction of the right of angle cylinders 154 angling blade 142 rightward, or yawing blade 142 clockwise when viewed from above, and the retraction of left of angle cylinder 150 and the extension of the right of angle cylinders 154 angling blade 142 "leftward, or yawing blade 142 counterclockwise when viewed from above. In alternative embodiments, blade 142 may be angled by a different mechanism or angle cylinders 154 may be configured differently.

Each of lift cylinders 150, tilt cylinder 152, and angle cylinders 154 is a double acting hydraulic cylinder. One end of each cylinder may be referred to as a head end, and the end of each cylinder opposite the head end may be referred to as a rod end. Each of the head end and the rod end may be fixedly connected to another component or, as in this embodiment, pivotally connected to another component, such as a through a pin-bushing or pin-bearing coupling, to name but two examples of pivotal connections. As a double acting hydraulic cylinder, each may exert a force in the extending or retracting direction. Directing pressurized hydraulic fluid into a head chamber of the cylinders will tend to exert a force in the extending direction, while directing pressurized hydraulic fluid into a rod chamber of the cylinders will tend to exert a force in the retracting direction. The head chamber and the rod chamber may both be located within a barrel of the hydraulic cylinder, and may both be part of a larger cavity which is separated by a movable piston connected to a rod of the hydraulic cylinder. The volumes of each of the head chamber and the rod chamber change with movement of the piston, while movement of the piston results in extension or retraction of the hydraulic cylinder. The movement of the piston refers to a stroke length wherein each of lift cylinders 150, tilt cylinder 152, and angle cylinders 154 can move from 0% to 100% of maximum stroke.

Figure 3:
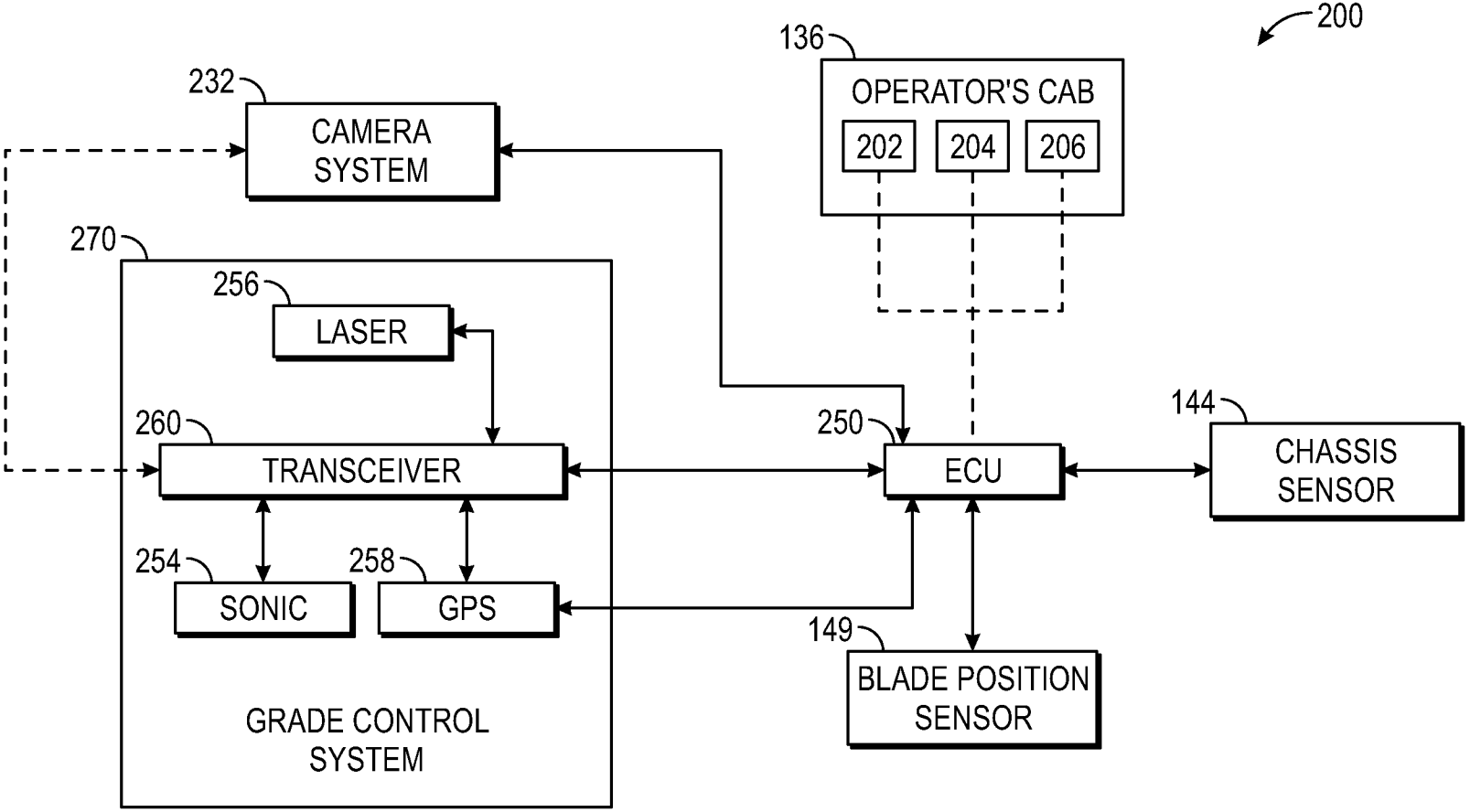
FIG. 3 is a schematic diagram of the work vehicle of FIG. 1 and a vehicle grade control system therein.

Referring now to FIG. 3, an embodiment of a control system 200 is shown for the work vehicle 100. The system 200 may be part of the work machine 100 of FIG. 1, which includes the operator's station or cab 136 having a plurality of controls 110. The plurality of controls 110 may include an input control device 202, a throttle control 204, and a user operating mode control 206. The input control device 202 may include a steering wheel, a brake control, a direction control, a joystick, lever or other control device for controlling the machine 100. Adjustment of the blade 142 is made by the operator using the plurality of controls 110 which are operably coupled to a controller 138 which is operatively coupled to the tilt cylinder 152, angle cylinders 154, and the lift cylinders 150. Adjustments of the blade 142 can also be made by actuating mechanisms configured to move the blade 142 in response to a control signal provided by an operator or in response to a control signal provided by a machine control system including sonic systems 254, laser systems 256, global positioning systems (GPS) 258, and a grade control system 270. The grade control system 270 is generally known in the industry. Some examples of grade control systems 270 include conventional or 2D grade-control systems and/or sonic systems 254, laser systems 256, and global positioning systems (GPS) 258. Other grade control systems 270 include sonic sensors or a laser transmitter and sensor along with machine-position sensors to display the cut and fill required to maintain grade on a monitor. Alternatively, the grade control systems 270 can include a 3D grade-control system.

The controller 138 in one or more embodiments, includes a processor operatively connected to a memory. In still other embodiments, the controller 138 is a distributed controller having separate individual controllers distributed at different locations on the vehicle 100. In addition, while the controller is generally hardwired by electrical wiring or cabling to related components, in other embodiments the controller 138 includes a wireless transmitter and/or receiver to communicate with a controlled or sensing component or device which either provides information to the controller or transmits controller information to controlled devices.

In FIG. 3, the controller 138 is configured as an electronic control unit (ECU) 250 that receives sensor data from multiple sources and is operatively connected to these sources. These sources include but are not limited to the blade position sensor 149, a camera system 232, a grade control system 270, and sensor 144 that are operatively connected to the ECU 250. The ECU 250 also receives inputs relating to commands from the operator. The ECU 250 is operatively connected to one or more user interfaces and sends information to the user interface and also sends control signals to the actuators including the lift cylinders 1502, angle cylinders 154, and the tilt cylinders 152.

The ECU 250, in different embodiments, includes a computer, computer system, or other programmable devices. In other embodiments, the ECU 150 can include one or more processors (e.g. microprocessors), and an associated memory, which can be internal to the processor or external to the processor. The memory can include random access memory (RAM) devices comprising the memory storage of the ECU 250, as well as any other types of memory, e.g., cache memories, non-volatile or backup memories, programmable memories, or flash memories, and read-only memories. In addition, the memory can include a memory storage physically located elsewhere from the processing devices and can include any cache memory in a processing device, as well as any storage capacity used as a virtual memory, e.g., as stored on a mass storage device or another computer coupled to ECU 250. The mass storage device can include a cache or other dataspace which can include databases. Memory storage, in other embodiments, is located in the "cloud", where the memory is located at a distant location, which provides the stored information wirelessly to the ECU 250.

The ECU 250 executes or otherwise relies upon computer software applications, components, programs, objects, modules, or data structures, etc. Software routines resident in the included memory of the ECU 250 or other memory are executed in response to the signals received. The computer software applications, in other embodiments, are located in the cloud. The executed software includes one or more specific applications, components, programs, objects, modules or sequences of instructions typically referred to as "program code". The program code includes one or more instructions located in memory and other storage devices which execute the instructions which are resident in memory, which are responsive to other instructions generated by the system, or which are provided a user interface operated by the user. The ECU 250 is configured to execute the stored program instructions.

A camera system 232 including an image sensor is fixedly mounted to the operator's station or cab 136 at a location generally unobstructed by any part of the vehicle 100. Other locations of the camera system 232 mounted on the work vehicle 100 are contemplated to provide a relatively unobstructed view of the rear face 143 of the blade 142, and in particular the first and second markers 147 and 151 or any additional markers on the blade 147. The camera system 232 includes one or more of an image sensor, transmitter, receiver, or a transceiver directed to the rear face 143 of the blade 142. In different embodiments, the camera system 232 includes one or more of a two dimensional camera, a three dimensional camera, a stereo camera, a monocular camera, a radar device, and a laser scanning device, an ultrasonic sensor, and a light detection and ranging (LIDAR) scanner. In different embodiments, the camera system 232 is one of a grayscale sensor, a color sensor, or a combination thereof.

The camera system 232 is configured to take a first image of the first marker 147 and a second image of the second marker 151, which are then transmitted to the ECU 250 of FIG. 3. The first and second images provided by the camera system 232 are used by the ECU 250 to determine the distances to the first and second markers 147 and 151 and the ECU 250 thereby determines the first and second locations of the first and second markers 147 and 151. For example, the first and second locations of the first and second markers 147 and 151 can include XYZ coordinates that correlate to the longitudinal direction 102, the lateral direction 108, and the vertical direction 110. The ECU 250 calibrates the grade control system 270 based on the first and second locations of the first and second markers 147 and 151. The grade control system 270 is calibrated in real-time as a stored first location of the first blade marker 147 is replaced with the first location of the first blade marker 147. Similarly, the grade control system 270 is calibrated as a stored second location of the second blade marker 151 is replaced with the second location of the second blade marker 151. The measurements for the stored first and second locations can be taken at the initial build of the work vehicle 100 in which the stored first location of the first blade marker 147 includes an initial first calibration location and the stored second location of the second blade marker 151 includes an initial second calibration location. These measurements for the stored first and second locations can be taken can also be taken at after usage of the work vehicle 100 wherein the stored first location of the first blade marker 147 includes a first calibration location and the stored second location of the second blade marker 151 includes a second calibration location. In one or more embodiments, the data determined by the ECU 250 based on the camera system 232 is provided as a feedback signal that is used when adjusting vehicle grade control system 408.

The work vehicle 100 can be moving when any of the lift cylinders 150, the tilt cylinder 152, and the angle cylinders 154 are operating, the camera system 232 is taking images of the first and second blade markers 147 and 151, and/or the ECU 250 is calibrating the grade control system 270.

The ECU 250 is also operatively connected to the blade position sensor 149 which is in turn operatively connected to the lift cylinders 150, the tilt cylinder 152, and the angle cylinders 154. The blade position sensor 149 is configured to identify the corresponding predetermined configuration of the lift cylinders 150, the tilt cylinder 152, and the angle cylinders 154 and transmit or send this information to the ECU 250. The ECU 250 also responds to grade status information, provided by the grade control system 270, the sonic system 154, the laser system 156, and/or the GPS 158, and adjusts the location of the blade 132 through control of the blade position sensor 149, and correspondingly the lift cylinders 150, the tilt cylinder 152, and the angle cylinders 154.

Figure 4:
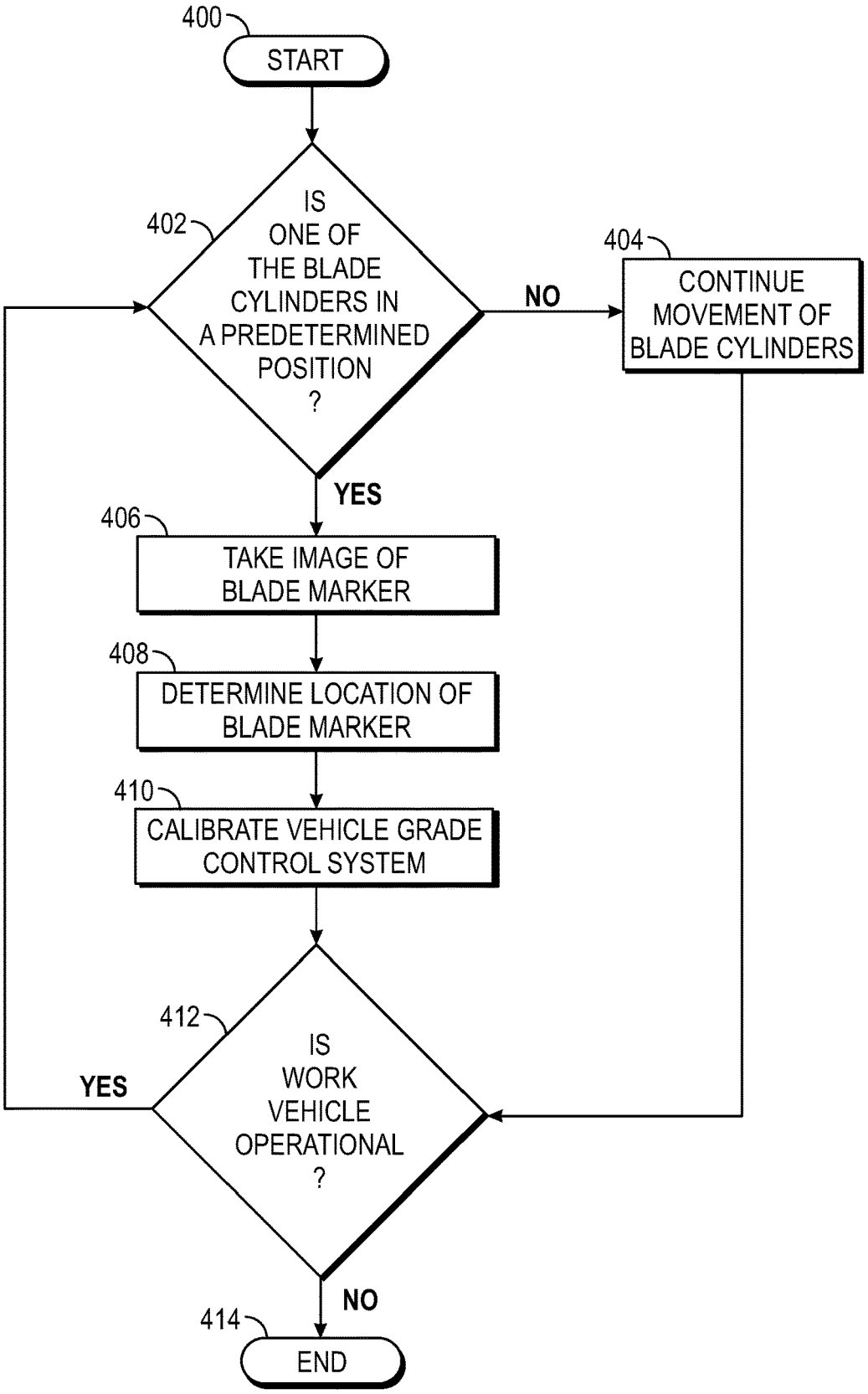
FIG. 4 is a flow diagram of a calibration process of the vehicle grade control system of the work vehicle of FIG. 1.

Turning now to FIG. 4 is a flow diagram of a control process 400 for calibrating the grade control system 270. In this control process 400 a plurality of blocks or steps may be performed. Block 402 includes determining if one of the lift cylinders 150, the tilt cylinder 152, and the angle cylinders 154 has moved to a predetermined configuration. As discussed above there are different ways to determine if block 402 is satisfied. For example, the sensor 149 may be configured to determine when any one or more of lift cylinders 150, tilt cylinder 152, and angle cylinders 154 reach a predetermined configuration or a percent of maximum stroke. Alternatively, the predetermined configuration of any of cylinders 150, 152, and 154 can be the maximum stroke or 100% of the stroke length or the minimum or 0% of the stroke length of the cylinder. The predetermined configuration of the lift cylinders 150, tilt cylinder 152, and the angle cylinders 154 can be any percentage of operable stroke for these cylinders. For example, in one form the predetermined configuration is 100% of maximum stroke of one of the cylinders 150, 152, and 154. When one of the cylinders 150, 152, and 154 reaches 100% of maximum stroke, the remaining two cylinders can be at any percentage of maximum stroke from 0% to 100%. In another form the predetermined configuration is 25% of maximum stroke of one of the cylinders 150, 152, and 154. When one of the cylinders 150, 152, and 154 reaches 25% of maximum stroke, the remaining two cylinders can be positioned at any percentage of maximum stroke from 0% to 100%. In other forms, the predetermined configuration can be 0, 30, 50, 75, or 90% of maximum stroke of one of the cylinders 150, 152, and 154, to name only a few examples. Two or more of the stroke lengths of the cylinders 150, 152, and 154 can reach the predetermined configuration to satisfy block 402.

In block 404, if one of the lift cylinders 150, the tilt cylinder 152, and the angle cylinders 154 has not moved to the predetermined configuration, then the operator continues usage and movement of the blade 142 and the lift cylinders 150, the tilt cylinder 152, and the angle cylinders 154.

In block 406, the camera system 232 interacts with the first and second markers 147 and 151 to take a first image of the first marker 147 and a second image of the second marker 151. If there are additional markers or only one marker, the camera system 232 will take the corresponding images. The camera system 232 communicates the first and second images, and any additional images, to the ECU 250.

In block 408, the ECU 250 determines a first location of the first marker 147 and a second location of the second marker 151 based on the first image and the second image. The first and second locations of the first and second markers 147 and 151 can include a vertical position of the blade or blade lift, roll left or roll right (which may be referred to as blade tilt, or tilt left and tilt right), and yaw left or yaw right (which may be referred to as blade angle, or angle left and angle right). Alternatively, the first and second locations of the first and second markers 147 and 151 can each include XYZ coordinates as measured relative to the longitudinal direction 102, the latitude 106 or the lateral direction, and the vertical 110 or the vertical direction. Generally the XYZ distances between the camera system 232 and the first and the second markers 147 and 151 are measured using the first and second images in block 408.

In block 410, the vehicle grade control system 270 is calibrated with the first and second locations of the first and second markers 147 and 151 of the blade 142. In particular, a stored first location of the first blade marker is replaced with the first location of the first blade marker and a stored second location of the second blade marker 151 is replaced with the second location of the second blade marker 151. The stored first location of the first blade marker 147 includes an initial first calibration location and the stored second location of the second blade marker 151 includes an initial second calibration location wherein the initial first and second calibration locations correspond with measurements at the initial build of the work vehicle 100 in which the work vehicle 100 has not been operational in the field. The stored first and second locations can alternatively include a first calibration location and a second calibration location that correspond with measurements after operational usage of the work vehicle 100 and/or the blade 142. The data determined by the ECU 250 based on the camera system 232 is provided as a feedback signal that is used when adjusting the vehicle grade control system 408.

In block 410, the ECU 250 calibrates the grade control system 270 based on the first location of the first blade marker by replacing a stored first location of the first blade marker 147 with the first location of the first blade marker 147. The ECU 250 also calibrates the grade control system 270 based on the second location of the second blade marker 151 by replacing a stored second location of the second blade marker 151 with the second location of the second blade marker 151.

In block 412, the control process 400 determines if the work vehicle 100 is operational. If the work vehicle 100 is not operational then the control process 400 ends at block 412. If the work vehicle 100 is operational then the control process 400 continues to block 402. Through continued usage of the work vehicle 100 and/or the blade 142, the grade control system 270 is recalibrated. Also beneficially, while the grade control system 270 is calibrated, the work vehicle 100 can be operational.

While exemplary embodiments incorporating the principles of the present disclosure have been described hereinabove, the present disclosure is not limited to the described embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A method for calibrating a grade control system of a work vehicle, the method comprising:

providing a work vehicle having a controller operatively connected to a camera, the work vehicle having a lift cylinder, a tilt cylinder, and an angle cylinder, operatively connected to a blade, the blade having a rear face with a first blade marker thereon;

moving one of the lift cylinder, the tilt cylinder, or the angle cylinder to a corresponding predetermined configuration that is designated for calibrating the grade control system;

taking a first image of the first blade marker with the camera while one of the lift cylinder, the tilt cylinder, or the angle cylinder is positioned in the corresponding predetermined configuration;

measuring, with the controller, a first location of the first blade marker using the first image; and calibrating, with the controller communicating with the camera, the grade control system based on the first location of the first blade marker by replacing a stored first location of the first blade marker with the first location of the first blade marker to account for wear on the work vehicle.

2. The method of claim 1, further comprising:

wherein the rear face of the blade includes a second blade marker thereon;

taking a second image of the second blade marker with the camera while one of the lift cylinder, the tilt cylinder, or the angle cylinder is positioned in the corresponding predetermined configuration;

measuring, with the controller, a second location of the second blade marker using the second image; and wherein the calibrating the grade control system includes based on the second location of the second blade marker replacing a stored second location of the second blade marker with the second location of the second blade marker to account for wear on the work vehicle.

3. The method of claim 2, wherein the stored first location of the first blade marker includes an initial first calibration location and the stored second location of the second blade marker includes an initial second calibration location.

4. The method of claim 2, wherein the stored first location of the first blade marker includes a first calibration location and the stored second location of the second blade marker includes a second calibration location.

5. The method of claim 2, wherein the predetermined configuration is 100% of a maximum stroke length of one of the lift cylinder, the tilt cylinder, or the angle cylinder.

6. The method of claim 2, wherein the predetermined configuration is between 0% and 100% of a maximum stroke length of one of the lift cylinder, the tilt cylinder, or the angle cylinder.

7. The method of claim 1, wherein the camera is mounted on the work vehicle.

8. The method of claim 1, further comprising:

operating the work vehicle during the calibrating of the grade control system.

9. A work vehicle, comprising:

a blade operatively attached to the work vehicle, the blade having a rear face with a first blade marker and a second blade marker thereon;

a lift cylinder, a tilt cylinder, and an angle cylinder operatively connected to the blade, the lift cylinder, the tilt cylinder, and the angle cylinder configured to move to a corresponding predetermined configuration that is designated for calibration of the grade control system;

a sensor system coupled to the lift cylinder, the tilt cylinder, and the angle cylinder, the sensor system configured to identify the corresponding predetermined configuration of the lift cylinder, the tilt cylinder, and the angle cylinder;

a camera mounted on the work vehicle, the camera configured to take a first image of the first blade marker and to take a second image of the second blade marker when any of the lift cylinder, the tilt cylinder, and the angle cylinder, are positioned in the corresponding predetermined configuration;

a grade control system mounted on the work vehicle; and a controller operatively connected to the sensor system, the camera, and the grade control system, wherein the controller further determines a first location of the first blade marker using the first image and a second location of the second blade marker using the second image, and the controller calibrates the grade control system based on the first location and the second location by replacing a stored first location of the first blade marker with the first location and replacing a stored second location of the second blade marker with the second location, wherein at least one of the first location and the second location account for wear on the work vehicle.

10. The work vehicle of claim 9, wherein the predetermined configuration is 100% of a maximum stroke length of one of the lift cylinder, the tilt cylinder, or the angle cylinder.

11. The work vehicle of claim 9, wherein the predetermined configuration is between 0% and 100% of a maximum stroke length of one of the lift cylinder, the tilt cylinder, or the angle cylinder.

12. The work vehicle of claim 9, wherein the first blade marker and the second blade marker are positioned near a top edge of the blade.

13. The work vehicle of claim 12, wherein the first blade marker and the second blade marker are positioned equidistant from a centerline of the blade.

14. The work vehicle of claim 9, wherein each of the first blade marker and the second blade marker include a sensor that interacts with the camera.

15. The work vehicle of claim 9, wherein the first blade marker and the second blade marker are machined into the rear face.

16. A method for calibrating a grade control system of a work vehicle, the method comprising:

providing a work vehicle having a controller operatively connected to a camera, the work vehicle having a plurality of cylinders operatively connected to a blade, the blade having a rear face with one or more blade markers thereon;

moving one of the plurality of cylinders to a corresponding predetermined configuration that is designated for calibrating the grade control system;

taking a corresponding image of the one or more blade markers with the camera after the moving one of the plurality of cylinders to the corresponding predetermined configuration;

measuring, with the controller, a corresponding location of the one or more blade markers using the corresponding image; and calibrating, with the controller communicating with the camera, the grade control system based on the corresponding location of the one or more blade markers by replacing a stored corresponding location of the one or more blade markers with the corresponding location of the one or more blade markers to account for wear on the work vehicle.

17. The method of claim 16, wherein the stored corresponding location includes an initial corresponding calibration location.

18. The method of claim 16, wherein the stored corresponding location includes a corresponding calibration location.

19. The method of claim 16, wherein the predetermined configuration is between 0% and 100% of a maximum stroke length of one of the plurality of cylinders.

20. The method of claim 16, further comprising:

operating the work vehicle during the calibrating of the grade control system.

* * * * *